US010768563B2

(12) United States Patent
Yamamoto

(10) Patent No.: US 10,768,563 B2
(45) Date of Patent: Sep. 8, 2020

(54) IMAGE FORMING SYSTEM WITH STRAIN DETECTION

(71) Applicant: KONICA MINOLTA, INC., Chiyoda-ku, Tokyo (JP)

(72) Inventor: Kenichi Yamamoto, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/289,996

(22) Filed: Mar. 1, 2019

(65) Prior Publication Data

US 2019/0271934 A1 Sep. 5, 2019

(30) Foreign Application Priority Data

Mar. 5, 2018 (JP) ..... 2018-038144

(51) Int. Cl.
*G03G 21/16* (2006.01)
*G03G 15/00* (2006.01)

(52) U.S. Cl.
CPC ..... *G03G 15/5008* (2013.01); *G03G 15/5004* (2013.01); *G03G 15/5066* (2013.01); *G03G 15/55* (2013.01); *G03G 21/1619* (2013.01); *G03G 2221/1678* (2013.01)

(58) Field of Classification Search
CPC ..... G03G 15/5008; G03G 15/5066; G03G 15/5004; G03G 21/16; G03G 21/1619; G03G 2221/1678; G03G 2221/1681
See application file for complete search history.

(56) References Cited

U.S. PATENT DOCUMENTS 5,335,043 A * 8/1994 Kluger ..... B65H 7/04 271/258.01
2002/0114650 A1* 8/2002 May ..... G03G 15/1605 399/302

FOREIGN PATENT DOCUMENTS

JP 2006243220 A 9/2006
JP 2009086489 A * 4/2009
JP 2013164507 A 8/2013

* cited by examiner

*Primary Examiner* — Walter L Lindsay, Jr.
*Assistant Examiner* — Laura Roth
(74) *Attorney, Agent, or Firm* — Cantor Colburn LLP

(57) ABSTRACT

An image forming system includes an image forming apparatus including a housing where an image forming unit is provided and a strain detector, a hardware processor, and a storage. The strain detector detects strain of a bottom plate of the housing. The processor and the storage are included in or provided outside the image forming apparatus. The processor obtains a first detection signal from the detector, stores strain measured data based on the first detection signal as reference data in the storage, obtains a second detection signal from the detector after storing the reference data, compares strain measured data based on the second detection signal with the reference data, and determines whether adjustment of a supporting point height of the bottom plate to reduce the strain due to change over time from a time of the obtainment of the reference data is required.

10 Claims, 11 Drawing Sheets

IMAGE FORMING SYSTEM WITH STRAIN DETECTION

CROSS REFERENCE TO RELATED APPLICATION

The present application claims priority under 35 U.S.C. § 119 to Japanese Application No. 2018-038144, filed Mar. 5, 2018, the entire contents of which are incorporated herein by reference.

BACKGROUND

1. Technological Field

The present invention relates to an image forming system.

2. Description of the Related Art

There is known an electrophotographic image forming apparatus which irradiates (exposes) a charged photoreceptor with (to) laser light based on image data, thereby forming an electrostatic latent image, develops the formed electrostatic latent image with a toner, thereby forming a toner image, transfers the formed toner image to paper, and fixes the transferred toner image by heat at a fixing unit, thereby forming an image on the paper.

If the image forming apparatus is installed on an uneven floor surface, its housing may incline (strain).

In this case, the strain of the housing may deviate units (a photosensitive drum and so forth) connected to the housing from their positions or put the units under load, which may decrease image quality or damage the image forming apparatus.

In particular, if, as shown in FIG. 14A and FIG. 14B, exposure devices 21 and 22 and photosensitive drums 23 to 26 are arranged so as to form lines in a horizontal direction, influence of the strain on images is significant.

Further, if, as shown in FIG. 14A and FIG. 14B, the upper surface of a bottom plate 3*a* of a housing 3 doubles as a part of a conveyance path 39, and the bottom plate 3*a* deforms by the strain of the housing 3, this affects the conveyance path 39, which may lead to paper jams or decrease in image quality.

Still further, even if the floor surface is flat at the time of the installation, as time elapses, the installation surface could sink by the weight of the image forming apparatus.

The strain of the housing occurs by the strain of the bottom of the housing which occurs by unevenness of the installation surface. Hence, it is important to suppress the strain of the bottom plate which constitutes the bottom of the housing.

As a method for suppressing the strain of the bottom plate of the housing, it may be thought of increasing rigidity of the bottom plate. However, there may be no space to ensure the rigidity, or it may increase costs.

Then, there is disclosed in JP 2006-243220 A providing water gauges at corners of the housing, the water gauges being connected to one another by pipes, and detecting displacement of the housing in a height direction from change in scales of the water gauges.

Further, there is disclosed in JP 2013-164507 A detecting toner images formed on an intermediate belt and relative positions of exposure units and the intermediate belt, and swinging rotary shafts of the intermediate belt according to the detection result.

However, the technology disclosed in JP 2006-243220 A can detect only heights at which the water gauges are positioned, and hence if the bottom plate strains as shown in FIG. 15, such a determination cannot be made. That is, even if displacements of the bottom plate of the housing in the height direction at the four corners are matched, the housing still could strain, and accordingly could not recover its initial shape with which normal operation of the image forming apparatus has been confirmed, the initial shape being a shape of the housing before shipping of the image forming apparatus.

Further, the technology disclosed in JP 2013-164507 A swings the rotary shafts of the intermediate belt according to color deviation caused by inclination of an exposure-units-arranged direction and a belt's conveyance direction with respect to one another due to deformation of the housing. This requires an additional mechanism which swings the rotary shafts of the intermediate belt. Further, the image forming apparatus may be damaged because deformation of the housing is unattended.

SUMMARY

Objects of the present invention include correcting strain of a bottom plate of a housing of an image forming apparatus to stabilize image forming, keep image quality, and extend its usable life.

To achieve at least one of the abovementioned objects, according to an aspect of the present invention, there is provided an image forming system including: an image forming apparatus including: an electrophotographic image forming unit which develops an electrostatic latent image with a toner; a housing in which the image forming unit is provided; and a strain detector which detects strain of a bottom plate of the housing; and a hardware processor and a storage which are included in the image forming apparatus or provided outside the image forming apparatus, wherein the hardware processor: obtains a first detection signal from the strain detector, and stores strain measured data based on the first detection signal as reference data in the storage; and obtains a second detection signal from the strain detector after storing the reference data in the storage, compares strain measured data based on the second detection signal with the reference data, and determines whether or not adjustment of a supporting point height of the bottom plate to reduce the strain of the bottom plate due to change over time from a time of the obtainment of the reference data is required.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention, wherein.

DETAILED DESCRIPTION OF EMBODIMENTS

Hereinafter, one or more embodiments of the present invention will be described with reference to the drawings. However, the scope of the present invention is not limited to the disclosed embodiments.

Figure 1:
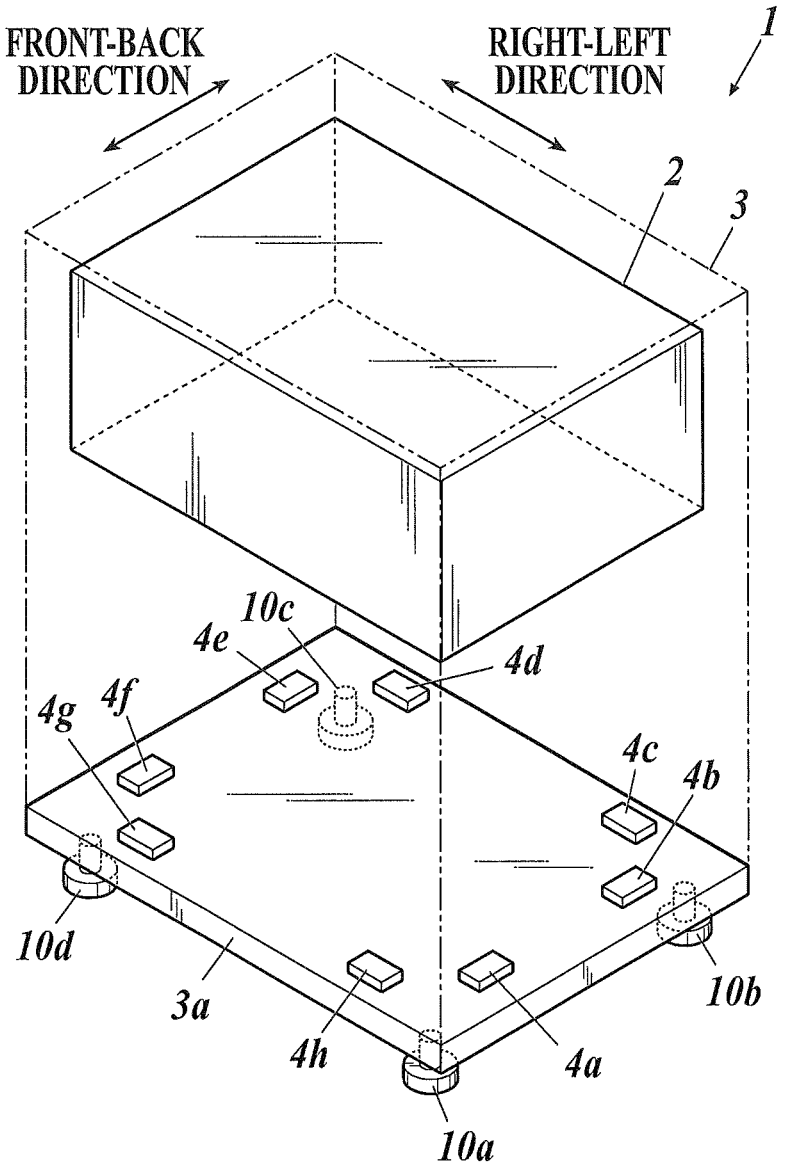
FIG. 1 is a schematic perspective view of an image forming apparatus according to an embodiment of the present invention.

As shown in FIG. 1, an image forming apparatus 1 of an embodiment includes: an electrophotographic image forming unit 2 which develops electrostatic latent images with toners; a housing 3 in which the image forming unit 2 is arranged; and strain detectors 4 (4*a*, 4*b*, 4*c*, etc.) which detect strain of a bottom plate 3*a* of the housing 3.

The image forming unit 2 includes photoreceptors, exposure devices and developing units for four colors, and an intermediate transfer belt. The image forming unit 2 has components which affect image quality if the housing 3 deforms. As each strain detector 4, an input device, such as a piezoelectric element or a strain gauge, is used. The input device changes its shape as the bottom plate 3*a* strains, and outputs an electric signal corresponding to the change in the shape.

Figure 2:
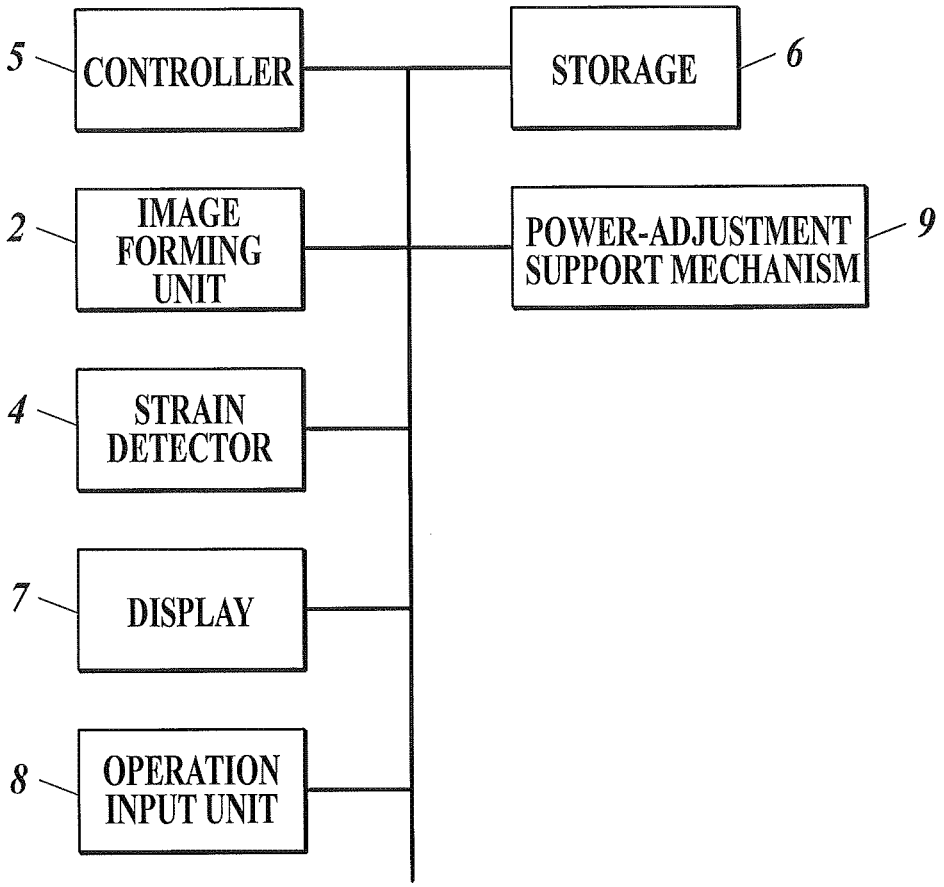
FIG. 2 is a block diagram showing configuration of an image forming system according to an embodiment of the present invention.

As shown in FIG. 2, an image forming system has a system configuration including, in addition to the image forming unit 2 and the strain detectors 4, a controller 5, a storage 6, and as optional components, a display 7 and an operation input unit 8, and power-adjustment support mechanisms 9. All the components may be included in the image forming apparatus 1, or one or more of the controller 5, the storage 6, the display 7 and the operation input unit 8 which can be provided outside the image forming apparatus 1 may be provided outside the image forming apparatus 1 so as to communicate and connect with the image forming apparatus 1.

The display 7 and the operation input unit 8 are optional components. However, this is a matter of whether or not they are used in carrying out the present invention. The image forming apparatus 1 generally has an operation display panel. If the display 7 and/or the operation input unit 8 are included in the image forming apparatus 1, this operation display panel generally included in the image forming apparatus 1 is used therefor. On the other hand, if the display 7 and/or the operation input unit 8 are provided outside the image forming apparatus 1, they are included in a terminal or the like which a serviceperson brings.

If the controller 5 and/or the storage 6 are included in the image forming apparatus 1, a CPU and an internal storage of the image forming apparatus 1 are used therefor, respectively. On the other hand, if the controller 5 and/or the storage 6 are provided outside the image forming apparatus 1, they are configured in a server which is communicable and connectable with the image forming apparatus 1, and linked to the image forming apparatus 1 or a terminal or the like which a serviceperson brings.

Figure 3:
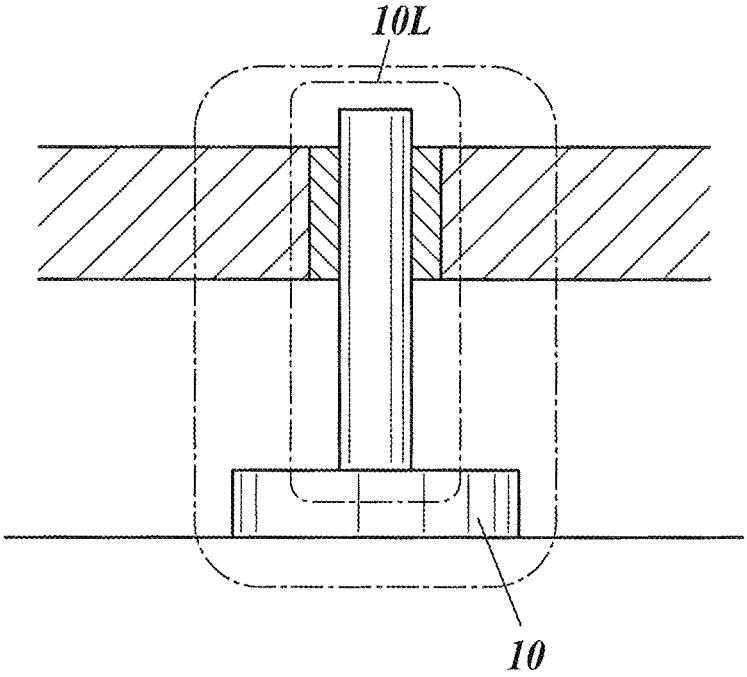
FIG. 3 is a schematic view of a manual-adjustment type supporting leg of the image forming apparatus according to an embodiment of the present invention.
Figure 4:
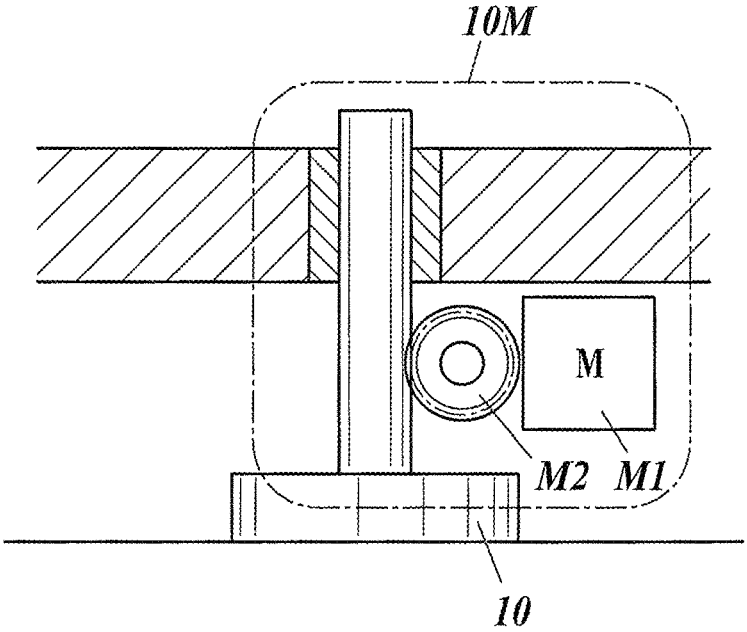
FIG. 4 is a schematic view of a power-adjustment type supporting leg of the image forming apparatus according to an embodiment of the present invention.

Each power-adjustment support mechanism 9 is a support mechanism which supports the bottom plate 3*a*, and adjusts a height at which a supporting point is positioned (which hereinafter is referred to as "supporting point height") by power. The power-adjustment support mechanism 9 may be replaced by a manual-adjustment support mechanism which supports the bottom plate 3*a*, and enables manual adjustment of the supporting point height. Each of (parts of) supporting legs 10, namely, 10*a*, 10*b*, 10*c* and 10*d*, constituting four supporting points of the bottom plate 3*a* shown in FIG. 1 is constituted by (a part of) the manual-adjustment support mechanism or the power-adjustment support mechanism 9. The manual-adjustment support mechanism is constituted by, for example, the supporting leg 10 provided with an adjuster 10L as shown in FIG. 3. The adjuster 10L is, for example, a screw mechanism. The power-adjustment support mechanism 9 is constituted by, for example, the supporting leg 10 provided with an adjuster 10M as shown in FIG. 4. The adjuster 10M includes a motor M1 and a transmission mechanism M2. The transmission mechanism M2 is a gear wheel or the like.

Hereinafter, a process for correcting the strain of the bottom plate 3*a* will be described together with the above variations.

Figure 5:
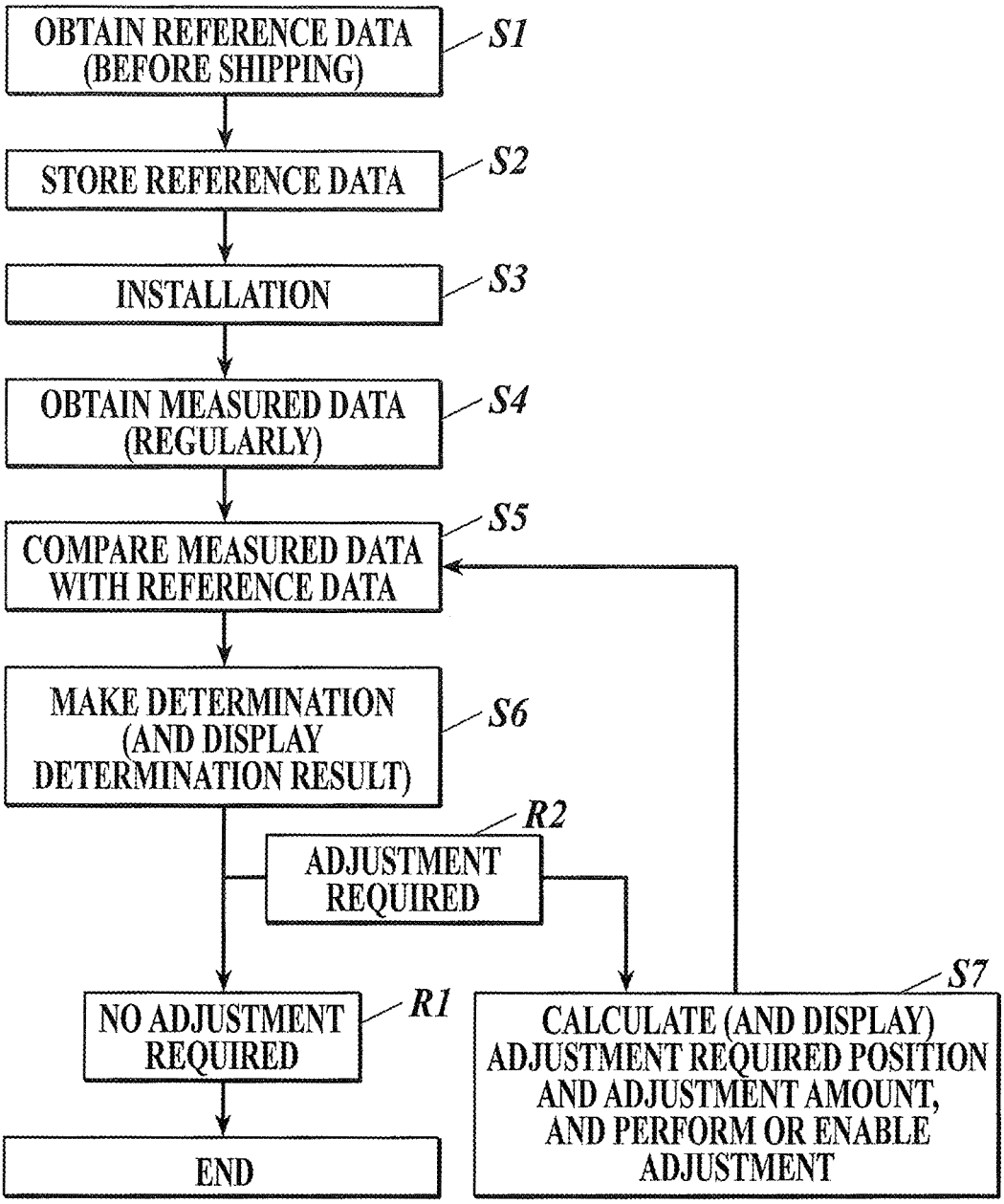
FIG. 5 is a flowchart showing an example of control of the image forming system according to an embodiment of the present invention.

Reference is made to a flowchart of FIG. 5.

First, the controller 5 obtains reference data (Step S1), and stores the reference data in the storage 6 (Step S2). That is, the controller 5 performs reference storing control to obtain detection signals from the strain detectors 4, and store strain measured data based on the detection signals as the reference data in the storage 6. The measured data are obtained by A/D conversion of analog values of the strain detectors 4*a*, 4*b*, 4*c*, . . . and 4*h* into numerical values, which are all that is needed, but may be obtained by conversion thereof into control values, display values or the like.

The reference storing control is performed, for example, at the time of inspection of the image forming apparatus 1 before shipping thereof. The measured data obtained in a housing 3 supported state when normal operation of the image forming apparatus 1 is confirmed are taken as the reference data. The reference data determine target of the adjustment, and hence it is preferable to obtain the reference data in the most ideal possible housing 3 supported state.

Next, the image forming apparatus 1 is installed in a place of use, for example, in an office (Step S3). The reference data may be obtained at an early stage of the installation. Alternatively, the reference data may be obtained at the time of maintenance of the image forming apparatus 1 after a predetermined period of use elapses. No matter whether it is before the shipping, at the early stage of the installation or any other time thereafter, as far as the normal operation of the image forming apparatus 1 can be confirmed, and the image forming apparatus 1 can be put in the housing 3 supported state which has no problem, this can be taken as the target of the adjustment.

After storing the reference data in the storage 6, the controller 5 performs in-use measurement control, for example, in response to a measurement instruction input from the operation input unit 8 or in response to arrival of a preset regular measurement time (Step S4). That is, after storing the reference data in the storage 6, the controller 5 obtains detection signals from the strain detectors 4 (Step S4).

Next, the controller 5 compares strain measured data based on the detection signals obtained in Step S4 with the reference data (Step S5).

Figure 6A:
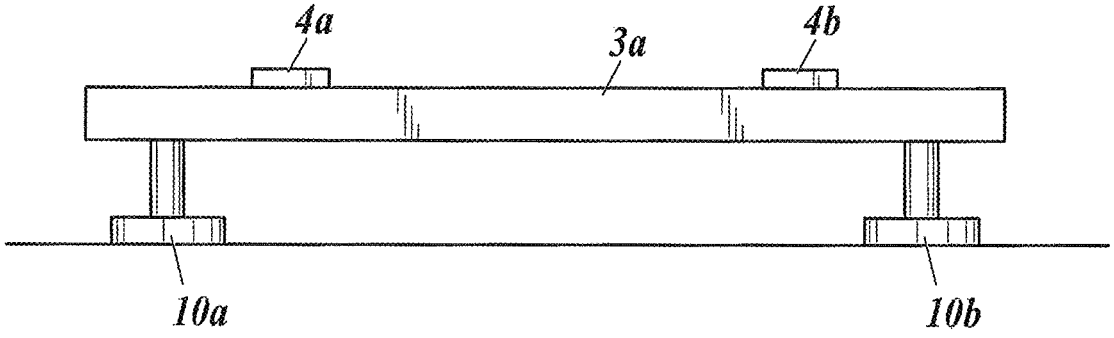
FIG. 6A is a schematic view showing an initial state of a bottom plate of the image forming apparatus according to an embodiment of the present invention.

When determining that a difference between a value of each of the strain detectors 4*a*, 4*b*, 4*c*, . . . and 4*h* and its corresponding reference value is within a predetermined acceptable range (first acceptable range), the controller 5 determines that the adjustment is not required, ends the process, and waits until the next measurement time comes (Step S6 (determination step)→Route R1→End; the bottom plate 3*a* is, for example, in a state shown in FIG. 6A). At the time, the controller 5 may display the determination result, such as "No Adjustment Required", on the display 7.

Figure 6B:
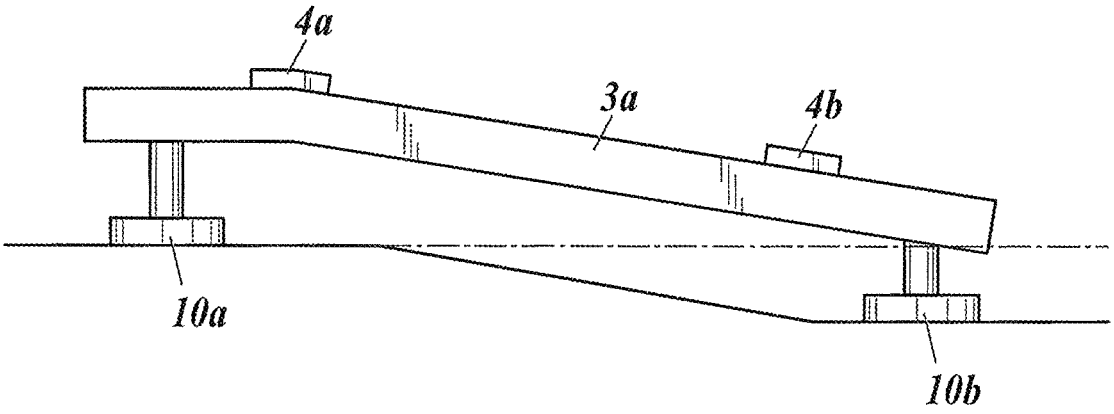
FIG. 6B is a schematic view showing a deformed state of the bottom plate of the image forming apparatus according to an embodiment of the present invention.

On the other hand, when determining that the difference between the value of any of the strain detectors 4*a*, 4*b*, 4*c*, . . . and 4*h* and its corresponding reference value is not within the first acceptable range, the controller 5 determines that the adjustment is required (Step S6 (determination step)→Route R2; the bottom plate 3*a* is, for example, in a state shown in FIG. 6B), and calculates an adjustment required position(s) where the supporting point height(s) needs to be adjusted (which hereinafter may be referred to as "supporting-point-height adjustment required position(s)" or simply "adjustment required position(s)") on the bottom plate 3*a* and its/their adjustment amount(s) (Step S7).

In Step S7, one of the following three ways (1) to (3) is carried out.

(1) If the supporting legs 10*a*, 10*b*, 10*c* and 10*d* are constituted by (parts of) the manual-adjustment support mechanisms, the controller 5 displays, on the display 7, the calculation result of the supporting-point-height adjustment required position on the bottom plate 3*a* and the adjustment amount. For example, the controller 5 displays a message of "Extend Supporting Leg 10*b* by 5 mm" on the display 7.

Then, an adjustment worker, for example, a user or a serviceperson, operates the supporting leg 10*b* so as to extend the supporting leg 10*b*, thereby raising the supporting point height of the bottom plate 3*a* at/with the supporting leg 10*b* (i.e., raising the height at which the supporting point constituted by (a part of) the supporting leg 10*b* is positioned).

Figure 6C:
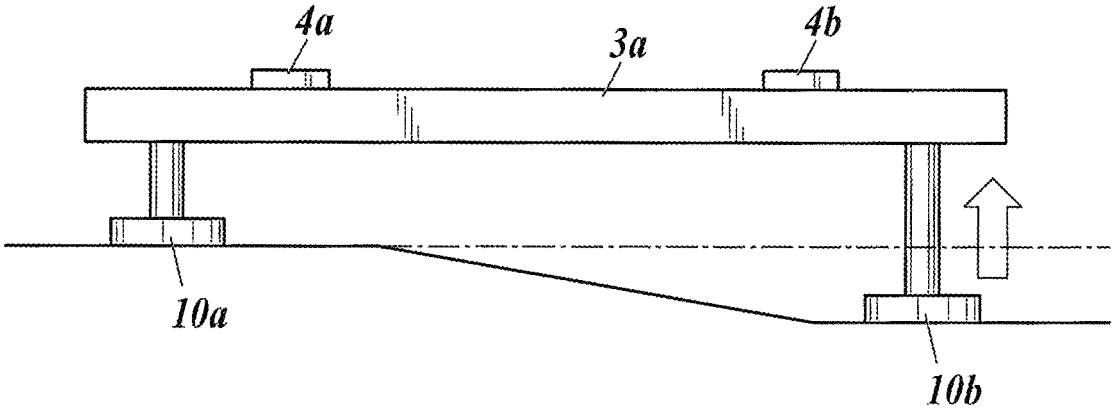
FIG. 6C is a schematic view showing a recovered state of the bottom plate of the image forming apparatus according to an embodiment of the present invention.

After the supporting point height is adjusted, the controller 5 repeats the process from Step S5. For example, the controller 5 displays a message of "Extend Supporting Leg 10*b* by Another 3 mm" on the display 7; after the supporting point height is further adjusted, updates the message to a message of "Extend Supporting Leg 10*b* by Another 1 mm"; and ultimately determines that the adjustment is not required, ends the process, and waits until the next measurement time comes (Step S6 (determination step)→Route R1→End; the bottom plate 3*a* is, for example, in a state shown in FIG. 6C). An acceptable range (second acceptable range) to bring the end of the adjustment work is narrower than the first acceptable range in order to avoid frequent request of the adjustment work. When ending the process, the controller 5 may display the determination result, such as a message of "Adjustment of Supporting Leg 10*b* Done", on the display 7 so that the adjustment worker can easily know that. If another adjustment required position is present, similarly to the above, the controller 5 displays, for example, a message of "Extend Supporting Leg 10*c* by 5 mm" on the display 7, and the adjustment work is performed.

As described above, in the case where the image forming apparatus 1 has the manual-adjustment support mechanisms which support the bottom plate 3*a*, and enable manual adjustment of the supporting point height, the controller 5 displays, on the display 7, the calculation result of the supporting-point-height adjustment required position on the bottom plate 3*a* and the adjustment amount before and after the adjustment. This can lead the adjustment work, which is performed by the adjustment worker, efficiently and rightly, and correct the strain of the bottom plate 3*a* properly.

(2) If the supporting legs 10*a*, 10*b*, 10*c* and 10*d* are constituted by (parts of) the power-adjustment support mechanisms 9 configured as manual-input power-adjustment support mechanisms, the controller 5 displays, on the display 7, the calculation result of the supporting-point-height adjustment required position on the bottom plate 3*a* and the adjustment amount. For example, the controller 5 displays a message of "Extend Supporting Leg 10*b* by 5 mm" on the display 7.

Then, the adjustment worker, for example, a user or a serviceperson, operates the operation input unit 8 so as to input an extension instruction to extend the supporting leg 10*b* (by 5 mm) as an adjustment instruction. In response to this, the controller 5 controls the power-adjustment supporting mechanism 9 for the supporting leg 10*b* to extend the supporting leg 10*b*, thereby raising the supporting point height of the bottom plate 3*a* at/with the supporting leg 10*b* (i.e., raising the height at which the supporting point constituted by (a part of) the supporting leg 10*b* is positioned).

As described above, the controller 5 controls, on the basis of the adjustment instruction from the operation input unit 8, the power-adjustment support mechanism 9 to adjust the supporting point height of the bottom plate 3*a*. The (2) way is the same as the (1) way except that the supporting point height is adjusted by power with the adjustment instruction manually input in the (2) way whereas the supporting point height is manually adjusted in the (1) way.

(3) If the supporting legs 10*a*, 10*b*, 10*c* and 10*d* are constituted by (parts of) the power-adjustment support mechanisms 9 configured as automatic-control power-adjustment support mechanisms, the controller 5 calculates the supporting-point-height adjustment required position on the bottom plate 3*a* and the adjustment amount as a control value(s), and controls, on the basis of the calculation result, the power-adjustment support mechanism 9 for the supporting leg 10 to adjust the supporting point height of the bottom plate 3*a* so as to reduce the strain of the bottom plate 3*a* due to change over time from the time of the obtainment of the reference data. A third acceptance range is set with respect to the reference data, and the supporting point height is adjusted such that the difference described above is within the third acceptance range. Because the supporting point height is adjusted by mechanical control, the third acceptance range is set to be narrower than the second acceptance range. For example, if the controller 5 determines that the adjustment required position is the supporting leg 10*a*, and calculates that the adjustment amount is 5.3 mm, the controller 5 performs control to extend the supporting leg 10*a* by 5.3 mm±0.05 mm, thereby putting the difference in the third acceptance range (±0.05 mm), and ends the process.

(Other Technical Matters)

Figure 7:
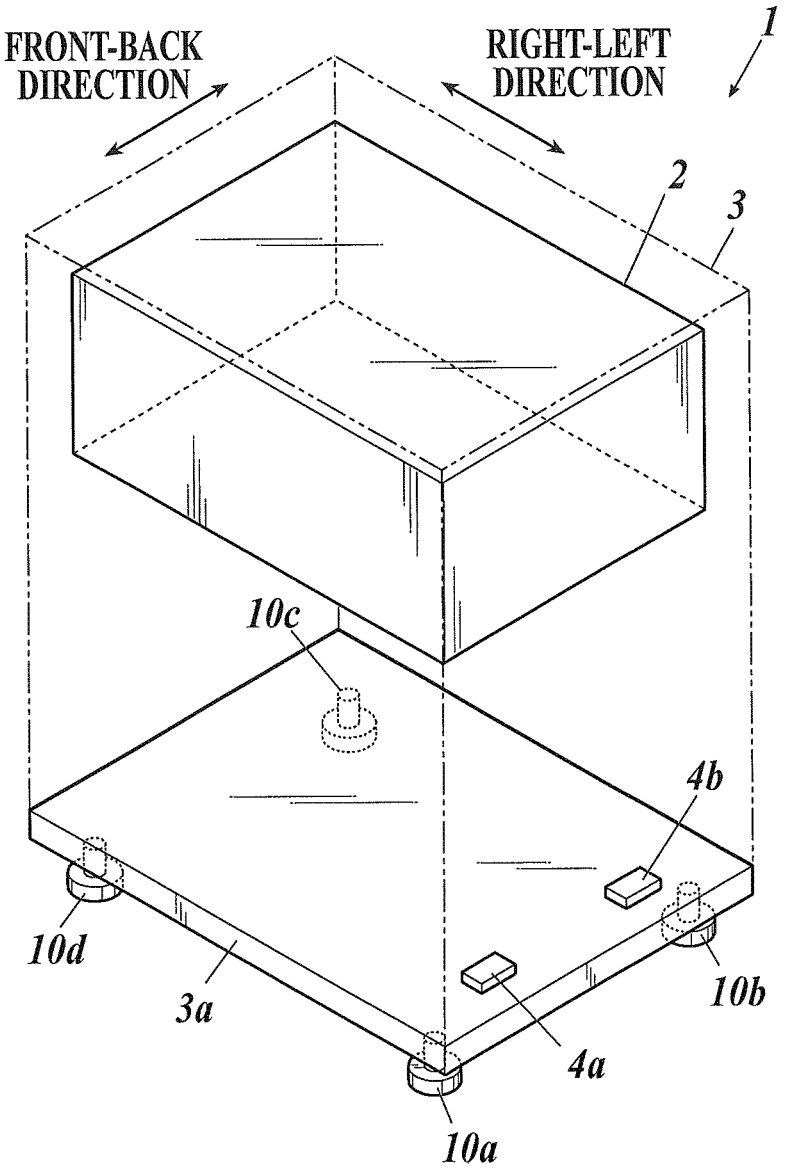
FIG. 7 is a schematic perspective view of the image forming apparatus according to an embodiment of the present invention, showing another example of an installation mode of strain detectors.

As shown in FIG. 1, each of the strain detectors 4*a*, 4*b*, 4*c*, . . . and 4*h* is installed between two supporting points of the bottom plate 3*a* so as to be closer to one of the two supporting points. The strain detector 4*a* is installed between the supporting leg 10*a* and the supporting leg 10*b* so as to be closer to the supporting leg 10*a*. The strain detector 4*b* is installed between the supporting leg 10*a* and the supporting leg 10*b* so as to be closer to the supporting leg 10*b*. The strain detector 4*c* is installed between the supporting leg 10*b* and the supporting leg 10*c* so as to be closer to the supporting leg 10*b*. Similarly, the detectors 4*d* to 4*h* are installed as shown in FIG. 1. The strain detectors 4*a* to 4*h* are installed in this way to identify the position of the supporting point which needs to be adjusted. It is not always necessary to install eight strain detectors 4 as shown in FIG. 1. For example, as shown in FIG. 7, the strain detectors 4 may be installed so as to detect the strain only at a part(s) and in a direction(s) desired to detect the strain if occurs. In the case shown in FIG. 7, only a twist(s) in the front-back direction on the right side (the side where the supporting legs 10*a* and 10*b* are installed) is detectable.

Preferably, the rigidity of the bottom plate 3*a* in a detection direction in which the strain detectors 4 perform the detection is higher at no-detection target parts than at detection target parts 31 where the strain detectors 4 perform the detection.

Figure 8A:
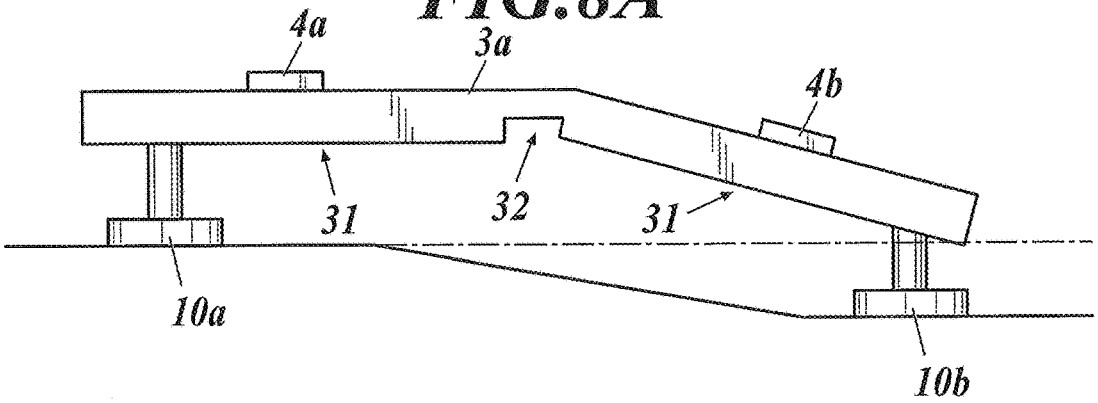
FIG. 8A is a schematic view showing a deformed state due to different degrees of rigidity in the bottom plate.

For example, if the rigidity is lower at no-detection target parts 32 than at the detection target parts 31 for the strain detectors 4, as shown in FIG. 8A, the bottom plate 3*a* could greatly deform at the no-detection target parts 32 where the rigidity is lower, and little deform at the detection target parts 31. Hence, the strain cannot be detected accurately.

Figure 8B:
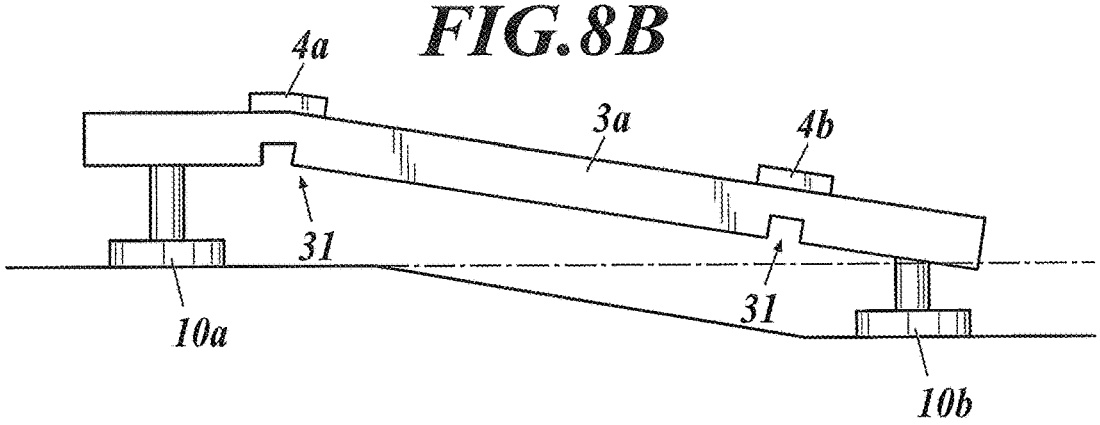
FIG. 8B is a schematic view showing a deformed state due to different degrees of rigidity in the bottom plate.

On the other hand, if the rigidity is higher at the no-detection target parts than at the detection target parts 31 for the strain detectors 4, as shown in FIG. 8B, the bottom plate 3*a* could greatly deform at the detection target parts 31, which corresponds to a fall of the supporting points. Hence, the strain can be detected accurately. Also, if the rigidity of the bottom plate 3*a* is uniform regardless of the parts, the bottom plate 3*a* could greatly deform at the detection target parts 31. Hence, the strain can be detected accurately.

Preferably, flexural rigidity of the bottom plate 3*a* between two supporting points of the bottom plate 3*a* is higher against bending deformation to be convex downward (which hereinafter may be referred to as "downward convex bending deformation") than against bending deformation to be convex upward (which hereinafter may be referred to as "upward convex bending deformation").

Figure 9A:
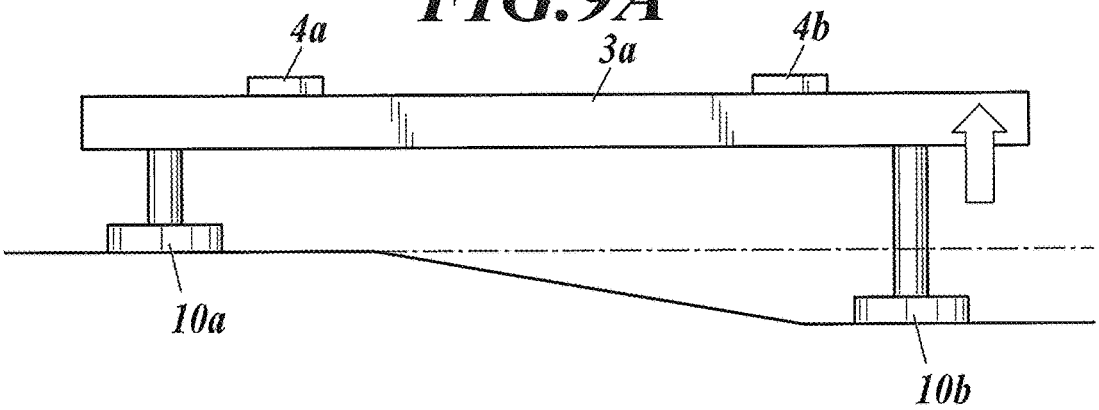
FIG. 9A is a schematic view to show a deformed state due to different degrees of rigidity in the bottom plate.
Figure 9B:
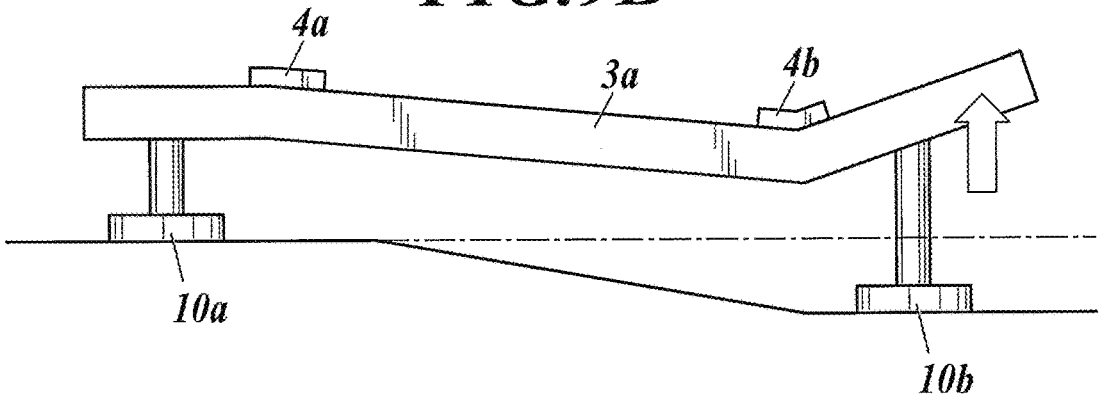
FIG. 9B is a schematic view to show the deformed state due to the different degrees of rigidity in the bottom plate.

As shown in FIG. 9A and FIG. 9B, if the downward convex bending deformation is on a par with the upward convex bending deformation in terms of the flexural rigidity between two supporting points of the bottom plate 3*a*, for example, when the supporting point constituted by (a part of) the supporting leg 10*b* falls, the bottom plate 3*a* bends and deforms to be convex upward at an installation place (detection target part) of the strain detector 4*a*, and accordingly the strain can be detected by the strain detector 4*a*, but when the supporting point constituted by (a part of) the supporting leg 10*b* is raised, because the downward convex bending deformation has the same level of deformability as the upward convex bending deformation, the bottom plate 3*a* may bend and deform to be convex downward between the supporting points, and accordingly may not be able to recover its normal shape (i.e., may deform as shown in FIG. 9B although hopefully it will recover its shape as shown in FIG. 9A).

Figure 10A:
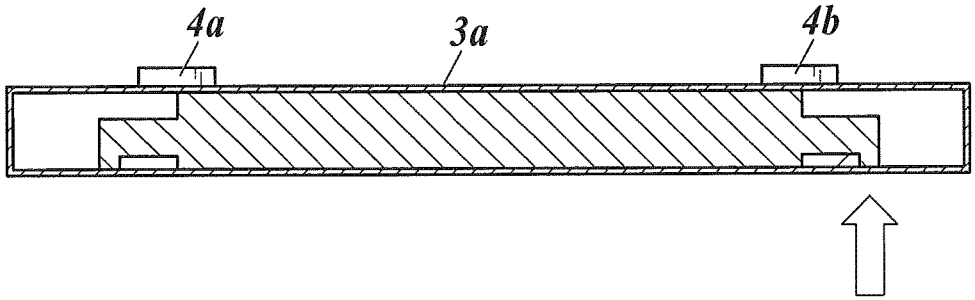
FIG. 10A is a schematic view to show a deformed state due to different degrees of rigidity in the bottom plate.
Figure 10B:
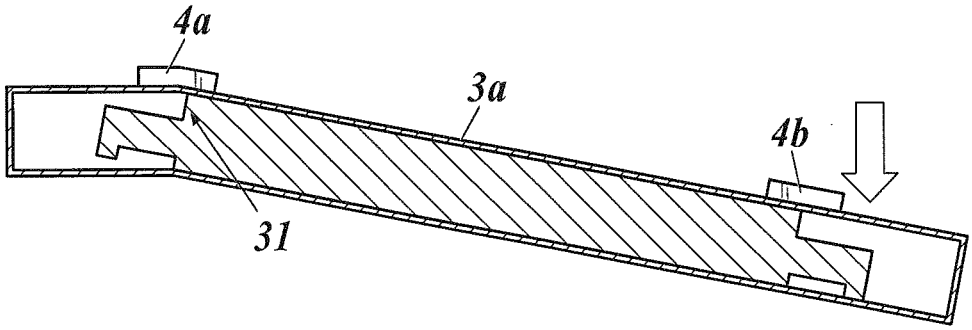
FIG. 10B is a schematic view to show the deformed state due to the different degrees of rigidity in the bottom plate.

On the other hand, as shown in FIG. 10A and FIG. 10B, if the bottom plate 3*a* is configured such that the flexural rigidity between two supporting points of the bottom plate 3*a* is higher against the downward convex bending deformation than against the upward convex bending deformation, for example, when the supporting point constituted by (a part of) the supporting leg 10*b* falls as shown in FIG. 10B, the bottom plate 3*a* bends and deforms to be convex upward at the installation place (detection target part) of the strain detector 4*a*, and accordingly the strain can be detected by the strain detector 4*a*, and when the supporting point constituted by (a part of) the supporting leg 10*b* is raised, because the downward convex bending deformation hardly occurs, the bottom plate 3*a* is likely to recover its normal shape as shown in FIG. 10A. The bottom plate 3*a* configured to have the rigidity lower against the upward convex bending deformation shown in FIG. 10A and FIG. 10B can simultaneously realize the rigidity higher at the no-detection target parts than at the detection target parts 31 for the strain detectors 4.

In the above, the adjustment is performed by extending the supporting leg 10 (10*b*). Thus, if the adjustment to reduce the strain of the bottom plate 3*a* due to change over time from the time of the obtainment of the reference data is performed by either of raising one of the supporting points of the bottom plate 3*a* and lowering another one of the supporting points thereof within their adjustable range, the controller 5 selects the raising, and calculates the supporting-point-height adjustment required position on the bottom plate 3*a* and the adjustment amount. This can bring the image forming apparatus 1 back to its initial installation height even if the installation surfaces of the supporting legs 10 subside by the (empty) weight of the image forming apparatus 1.

The raising has priority over the lowering as far as it can be performed within the adjustable range. For example, if the supporting leg 10*b* has been already extended to the upper limit of the adjustable range, the adjustment is dealt with by shortening the supporting leg 10*a*.

Hereinafter, calculation principles of the adjustment required positions and the adjustment amounts will be described.

In the following, a strain gauge is used as each strain detector 4 as an example.

Figure 11:
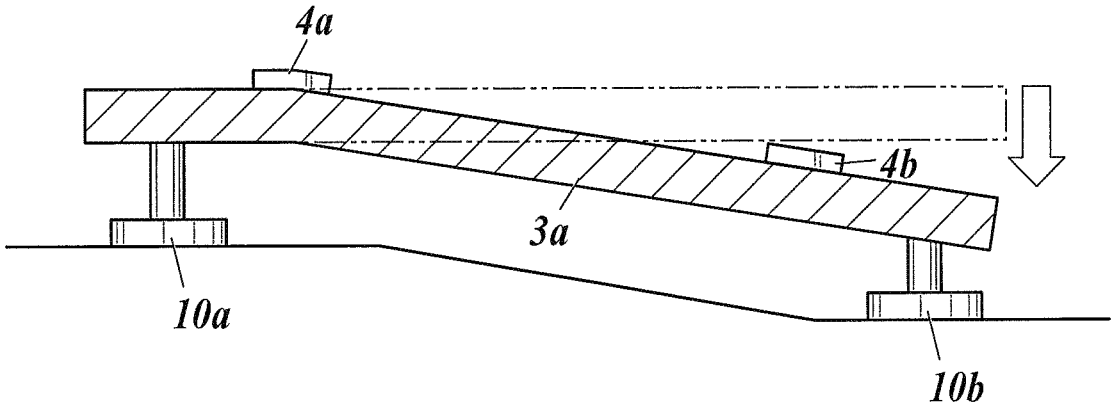
FIG. 11 is a schematic view to show a relationship between deformation (strain) of the bottom plate and its detection.

The strain gauge detects strain from change in electric resistance due to expansion/contraction of a metal foil provided in the strain gauge, by making use of the fact that electric resistance changes by metal expanding or contracting. Hence, as shown in FIG. 11, the strain of the bottom plate 3*a* is detected by the strain gauges as the strain defectors 4 stuck to the bottom plate 3*a*. When the bottom plate 3*a* strains, the strain gauge(s) expands or contracts, and electric resistance changes proportionally, so that the change is detected as a voltage value(s). For example, when the bottom plate 3*a* is in the initial state, namely, the strain of the bottom plate 3*a* is 0 mm, the strain gauge voltage is 0 mV; when the strain of the bottom plate 3*a* is −1 mm, the strain gauge voltage is −1 mV; and when the strain of the bottom plate 3*a* is −2 mm, the strain gauge voltage is −2 mV. Thus, the voltage is proportional to the strain.

Detection Example 1

Figure 12A:
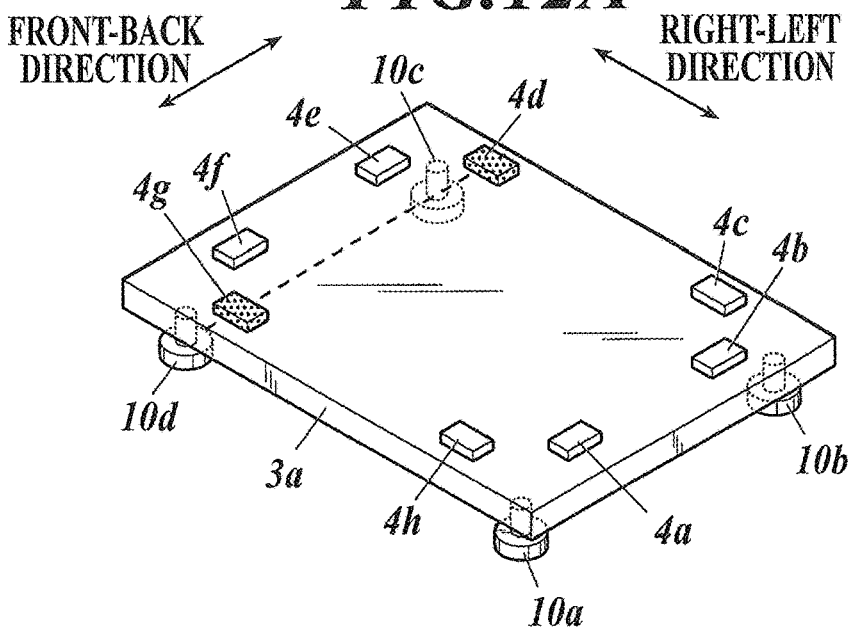
FIG. 12A is a schematic view to show an example of the relationship between deformation of the bottom plate and its detection.
Figure 12B:
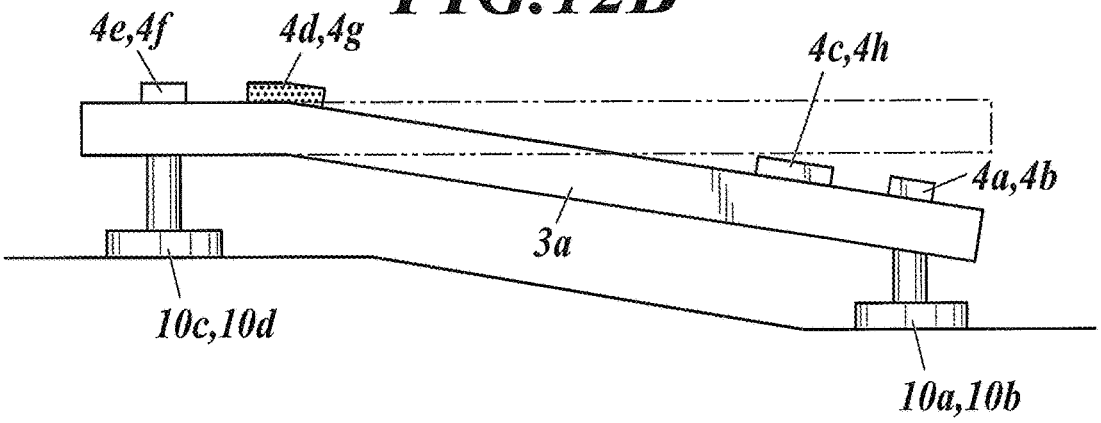
FIG. 12B is a schematic view to show the example of the relationship between deformation of the bottom plate and its detection.
Figure 12C:
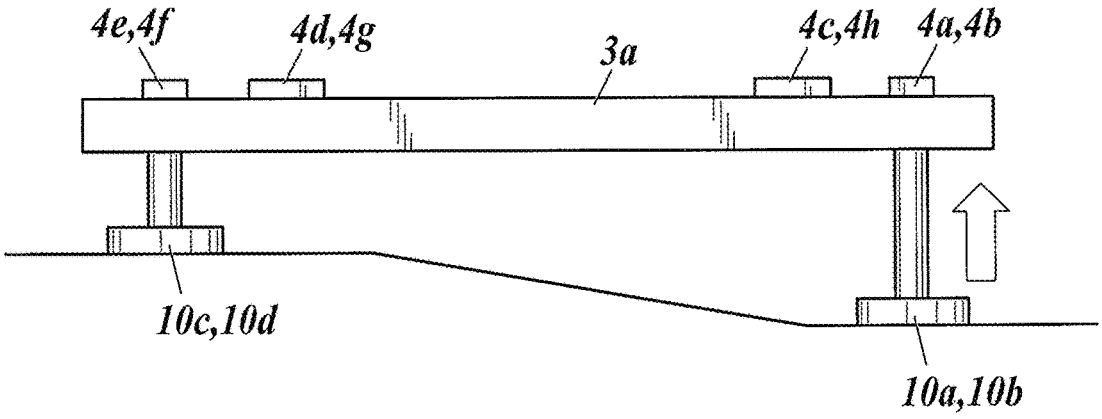
FIG. 12C is a schematic view to show the example of the relationship between deformation of the bottom plate and its detection.

If the strain occurs in the bottom plate 3*a* in the right-left direction (the supporting legs 10*a* and 10*b* sink) as shown in FIG. 12A and FIG. 12B, voltages of the strain detectors 4*d* and 4*g*, which are within spans from the sunk supporting legs 10*a* and 10*b* and face (i.e., on the far side from) the supporting legs 10*a* and 10*b*, change, and voltages of the other strain detectors 4 do not change. Consequently, the supporting legs 10*a* and 10*b* are identified as the adjustment required positions, their adjustment amounts are calculated from the voltage levels, and the supporting legs 10*a* and 10*b* are adjusted by the adjustment amounts. Thus, the strain of the bottom plate 3*a* is solved as shown in FIG. 12C.

Detection Example 2

Figure 13A:
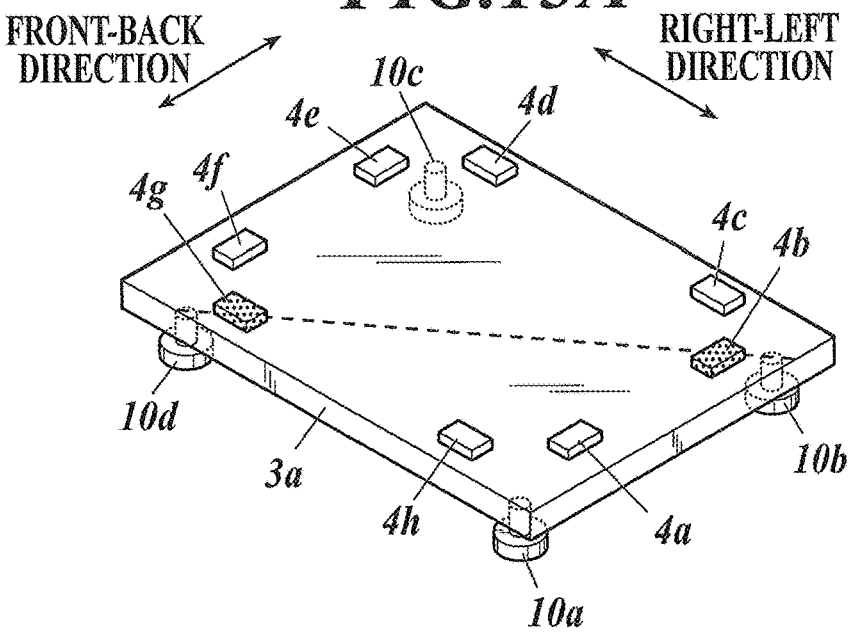
FIG. 13A is a schematic view to show another example of the relationship between deformation of the bottom plate and its detection.
Figure 13B:
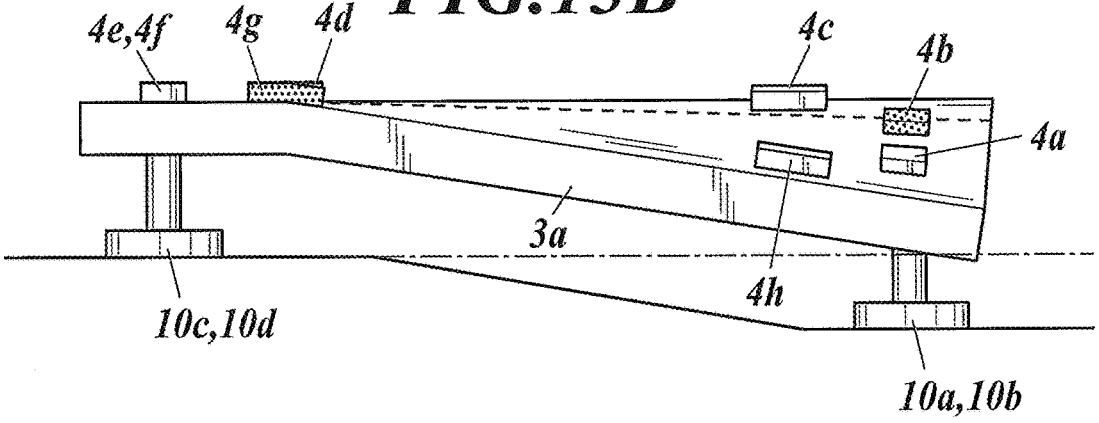
FIG. 13B is a schematic view to show the example of the relationship between deformation of the bottom plate and its detection.
Figure 13C:
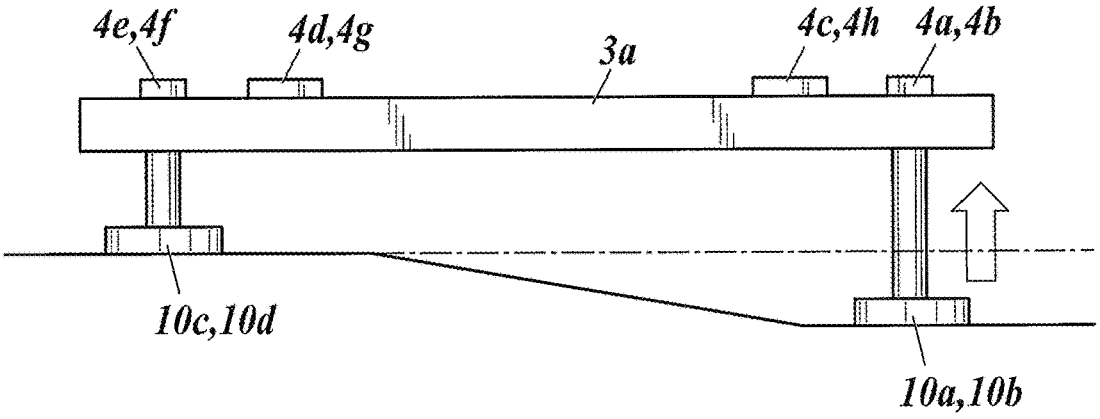
FIG. 13C is a schematic view to show the example of the relationship between deformation of the bottom plate and its detection.
Figure 14A:
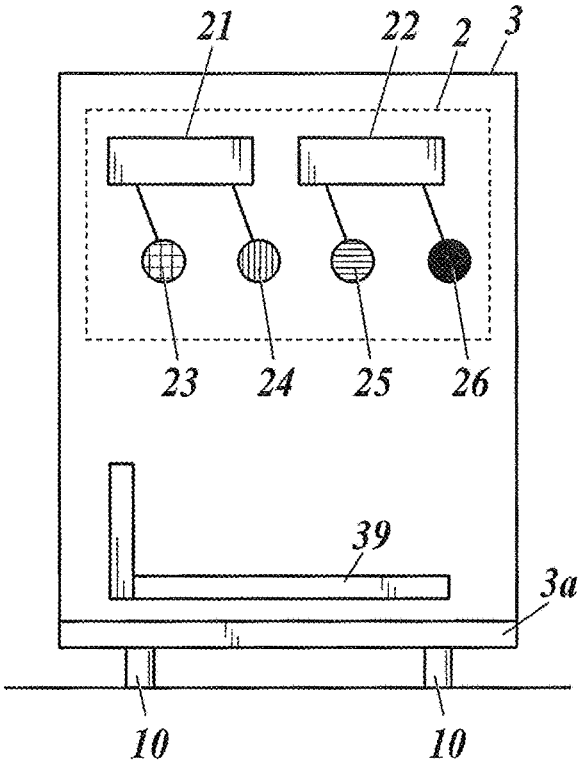
FIG. 14A is a schematic view of the image forming apparatus to show influence of the strain of a housing.
Figure 14B:
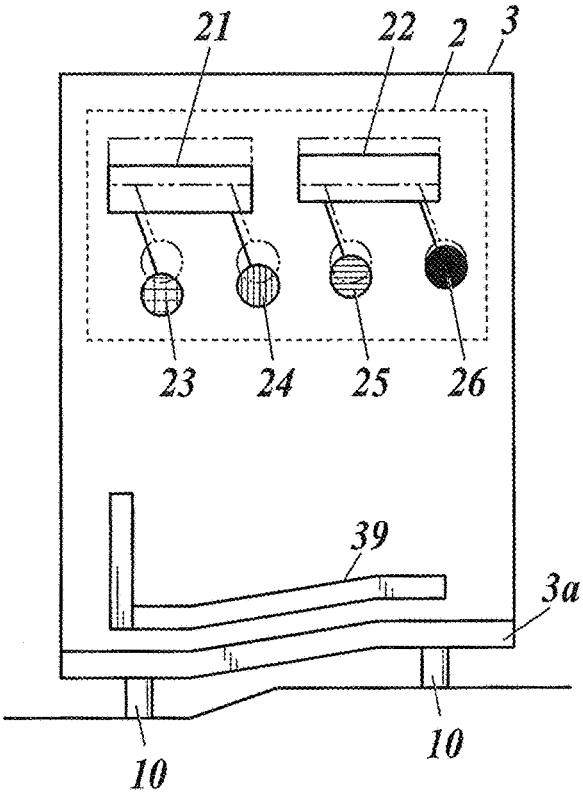
FIG. 14B is a schematic view of the image forming apparatus to show the influence of the strain of the housing.
Figure 15:
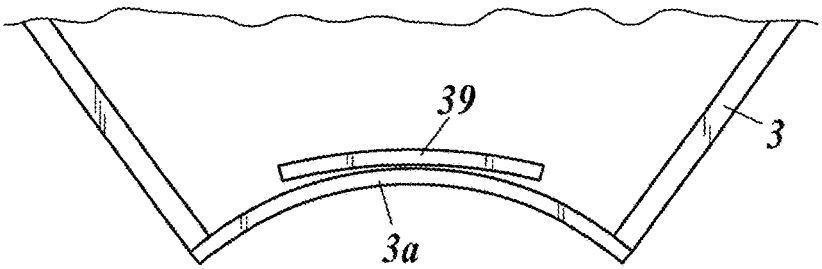
FIG. 15 is a schematic view showing one of deformed modes of the housing of the image forming apparatus.

If the strain occurs in the bottom plate 3*a* in the right-left direction and the front-back direction (the supporting leg 10*a* sinks) as shown in FIG. 13A and FIG. 13B, voltages of the strain detectors 4*b* and 4*g*, which are within spans from the sunk supporting leg 10*a* and face (i.e., on the far side from) the supporting leg 10*a*, change, and voltages of the other strain detectors 4 do not change. Consequently, the supporting leg 10*a* is identified as the adjustment required position, its adjustment amount is calculated from the voltage levels, and the supporting leg 10*a* is adjusted by the adjustment amount. Thus, the strain of the bottom plate 3*a* is solved as shown in FIG. 13C.

By reference to the case shown in FIG. 8B and the case shown in FIG. 10A and FIG. 10B, the bottom plate 3*a* is designed such that deformability thereof is higher at the detection target part(s) for some or all of the strain detectors 4.

As described above, the adjustment required positions can be detected from all the supporting points, and their adjustment amounts can be calculated.

Detailed configurations and detailed operations of the units and the like constituting the image forming system can be appropriately modified without departing from the scope of the present invention.

Although some embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-038144 filed on Mar. 5, 2018 is incorporated herein by reference in its entirety.

What is claimed is:

1. An image forming system comprising:

an image forming apparatus including: an electrophotographic image forming unit which develops an electrostatic latent image with a toner; a housing in which the image forming unit is provided; and a strain detector which detects strain of a bottom plate of the housing; and a hardware processor and a storage which are included in the image forming apparatus or provided outside the image forming apparatus, wherein the hardware processor:

obtains a first detection signal from the strain detector, and stores strain measured data based on the first detection signal as reference data in the storage; and obtains a second detection signal from the strain detector after storing the reference data in the storage, compares strain measured data based on the second detection signal with the reference data, and determines whether or not adjustment of a supporting point height of the bottom plate to reduce the strain of the bottom plate due to change over time from a time of the obtainment of the reference data is required, and wherein the hardware processor displays, on a display, a calculation result of: an adjustment required position where the supporting point height needs to be adjusted on the bottom plate; and an adjustment amount.

2. The image forming system according to claim 1, wherein the image forming apparatus includes a manual-adjustment support mechanism which supports the bottom plate, and allows manually adjusting the supporting point height.

3. The image forming system according to claim 1, wherein the image forming apparatus includes: a power-adjustment support mechanism which supports the bottom plate, and adjusts the supporting point height by power; and an input unit with which an adjustment instruction to adjust the supporting point height is input, and the hardware processor controls, based on the adjustment instruction from the input unit, the power-adjustment support mechanism to adjust the supporting point height of the bottom plate.

4. The image forming system according to claim 1, wherein the image forming apparatus includes a power-adjustment support mechanism which supports the bottom plate, and adjusts the supporting point height by power, and the hardware processor controls, based on a calculation result of: an adjustment required position where the supporting point height needs to be adjusted on the bottom plate; and an adjustment amount, the power-adjustment support mechanism to adjust the supporting point height of the bottom plate so as to reduce the strain of the bottom plate due to the change over time from the time of the obtainment of the reference data.

5. The image forming system according to claim 1, wherein the strain detector includes an input device which changes shape as the bottom plate strains, and outputs an electric signal corresponding to the change in the shape.

6. The image forming system according to claim 5, wherein the input device is a piezoelectric element.

7. The image forming system according to claim 1, wherein flexural rigidity of the bottom plate between two supporting points of the bottom plate is higher against bending deformation to be convex downward than against bending deformation to be convex upward.

8. The image forming system according to claim 1, wherein if the adjustment to reduce the strain of the bottom plate due to the change over time from the time of the obtainment of the reference data is performed by either of raising one of supporting points of the bottom plate and lowering another one of the supporting points within an adjustable range of the supporting points, the hardware processor selects the raising, and calculates an adjustment required position where the supporting point height needs to be adjusted on the bottom plate and an adjustment amount.

9. An image forming system comprising:

an image forming apparatus including, an electrophotographic image forming unit which develops an electrostatic latent image with a toner: a housing in which the image forming unit is provided; and a strain detector which detects strain of a bottom plate of the housing; and a hardware processor and a storage which are included in the image forming apparatus or provided outside the image forming apparatus, wherein the hardware processor:

obtains a first detection signal from the strain detector, and stores strain measured data based on the first detection signal as reference data in the storage; and obtains a second detection signal from the strain detector after storing the reference data in the storage, compares strain measured data based on the second detection signal with the reference data, and determines whether or not adjustment of a supporting point height of the bottom plate to reduce the strain of the bottom plate due to change over time from a time of the obtainment of the reference data is required, wherein the strain detector is provided between two supporting points of the bottom plate so as to be closer to one of the two supporting points.

10. An image forming system comprising:

an image forming apparatus including, an electrophotographic image forming unit which develops an electrostatic latent image with a toner; a housing in which the image forming unit is provided; and a strain detector which detects strain of a bottom plate of the housing; and a hardware processor and a storage which are included in the image forming apparatus or provided outside the image forming apparatus, wherein the hardware processor:

obtains a first detection signal from the strain detector, and stores strain measured data based on the first detection signal as reference data in the storage, and obtains a second detection signal from the strain detector after storing the reference data in the storage, compares strain measured data based on the second detection signal with the reference data, and determines whether or not adjustment of a supporting point height of the bottom plate to reduce the strain of the bottom plate due to change over time from a time of the obtainment of the reference data is required, wherein rigidity of the bottom plate in a detection direction in which the strain detector performs the detection is higher at a no-detection target part than at a detection target part where the strain detector performs the detection.

* * * * *